US006076651A

United States Patent [19]

Furneaux

[11] Patent Number: 6,076,651

[45] Date of Patent: Jun. 20, 2000

[54] COIN DIAMETER MEASUREMENT

[75] Inventor: David Michael Furneaux, Reading, United Kingdom

[73] Assignee: Mars Incorporated, McLean, Va.

[21] Appl. No.: 09/117,480

[22] PCT Filed: Jan. 24, 1997

[86] PCT No.: PCT/GB97/00229

§ 371 Date: Oct. 16, 1998

§ 102(e) Date: Oct. 16, 1998

[87] PCT Pub. No.: WO97/29460

PCT Pub. Date: Aug. 14, 1997

[30] Foreign Application Priority Data

Feb. 8, 1996 [GB] United Kingdom ..... 9602533

[51] Int. Cl.[7] ..... G07D 5/02

[52] U.S. Cl. ..... 194/317

[58] Field of Search ..... 194/317, 318, 194/319

[56] References Cited

U.S. PATENT DOCUMENTS

| | | | |
|---|---|---|---|
| 4,353,453 | 10/1982 | Partin et al. . | |
| 4,432,447 | 2/1984 | Tanaka . | |
| 4,441,602 | 4/1984 | Ostroski et al. . | |
| 4,492,296 | 1/1985 | Dubey . | |
| 4,660,705 | 4/1987 | Kai et al. . | |
| 4,971,187 | 11/1990 | Furuya et al. . | |
| 5,002,174 | 3/1991 | Yoshihara | 194/317 |
| 5,067,604 | 11/1991 | Metcalf | 194/203 |
| 5,293,979 | 3/1994 | Levasseur | 194/317 |
| 5,871,075 | 2/1999 | Takayama et al. | 194/318 |

FOREIGN PATENT DOCUMENTS

| | | |
|---|---|---|
| 0 017 370 | 10/1980 | European Pat. Off. . |
| 0 062 411 | 10/1982 | European Pat. Off. . |
| 0 202 378 | 11/1986 | European Pat. Off. . |
| 0 566 154 | 10/1993 | European Pat. Off. . |
| WO 93/04448 | 3/1993 | WIPO . |

*Primary Examiner*—F. J. Bartuska
*Attorney, Agent, or Firm*—Fish & Richardson P.C.

[57] ABSTRACT

A coin diameter measuring circuit uses a pair of coils coupled in the feedback path of an oscillator so that the oscillator frequency depends on the inductances of the coils and the mutual inductance therebetween. The coils are switched between aiding and opposing configurations when the coin passes between them, the oscillator frequency in each configuration is measured, and the difference between the frequencies is determined to provide an indication of the mutual indictance of the coils and, thus, the diameter of the coin. Preferably, the diameter is determined by the difference between the measured mutual inductance with the coin present and the coin absent.

18 Claims, 1 Drawing Sheet

COIN DIAMETER MEASUREMENT

BACKGROUND

This invention relates to a method and apparatus for measuring coin diameter.

The invention will be described in the context of coin validators, but it is to be noted that the term "coin" is employed to mean any coin (whether valid or counterfeit), token, slug, washer, or other metallic object or item, and especially any metallic object or item which could be utilised by an individual in an attempt to operate a coin-operated device or system. A "valid coin" is considered to be an authentic coin, token, or the like, and especially an authentic coin of a monetary system or systems in which or with which a coin-operated device or system is intended to operate and of a denomination which such coin-operated device or system is intended selectively to receive and to treat as an item of value.

One known technique for measuring the diameter of a coin involves using an electromagnetic coil as part of an oscillator circuit so that the frequency of the oscillator output is dependent upon the inductance of the coil. A coin is caused to move past the coil and the changing frequency is measured. This is indicative of coin diameter, because the frequency shift is determined by the change of inductance, which is in turn dependent upon the area of overlap between the coil and the coin. For effective results, the coil should be large, and preferably larger than the largest-sized diameter coin to be measured. The frequency of the oscillator should be high so that the measurement is substantially unaffected by coin thickness.

One problem with this technique is that the measurement will be affected by "lift-off", i.e. the separation between the coil and the coin, which is difficult to control accurately. To compensate for this effect, it is known to use a second coil on the opposite side of the coin, the two coils being connected together in the oscillator circuit. Thus, increased lift-off will diminish the effect of the coin on one coil, but increase the effect on the other coil.

Although this improves matters, it is still not possible to obtain a very high resolution measurement using this technique. This is primarily due to coin embossing, which effectively superimposes a noise on the measurement. The result is that the embossing can cause an effect on the diameter measurement which depends upon the orientation of the coin at the point at which the diameter measurement is taken (i.e. at the peak of the frequency shift caused as the coin passes the coils). Normally, the separation between the coils is quite large (to allow for different-thickness coins), the coin passing in close proximity to one of the coils, and being spaced further away from the other coil. In this situation the diameter measurement may also be dependent upon which face of the coin is closest to the nearest coil.

A different technique, which avoids the effects of embossing, involves again using two coils, but in this case one of the coils is driven to form a transmission coil, and the other is a receiving coil. As a coin passes between the coils, it effectively acts as a shield and the coupling, i.e. the mutual inductance, between the coils decreases. The degree to which this happens is a function of the coin diameter.

However, it is necessary for the transmission sensor to be driven at a very high frequency not merely to avoid the effects of coin thickness, but also to ensure that the coin acts as an effective shield. If the coin diameter increases, the received signal level decreases, so that it is necessary to sense low level signals at high frequencies, which is in practice difficult to achieve.

SUMMARY

According to the present invention, there is provided a method of detecting the diameter of a coin, the method comprising the step of passing the coin between a pair of inductances coupled in a oscillator circuit such that the oscillator frequency is dependent upon the values of the inductances and the mutual inductance therebetween, switching the inductances between an aiding configuration and an opposing configuration while the coin is passing therebetween, and providing a diameter-indicating measurement dependent upon the difference between the frequencies of the oscillator while the inductances are in the aiding and opposing configurations.

The invention also extends to apparatus arranged to operate in accordance with this technique.

In the preferred embodiment each inductance is a single coil; however, any suitable circuit element, or combination of circuit elements, which has appropriate inductive properties could be used (such as a printed circuit track, or multiple interconnected coils), and the term "coil" is therefore used herein to denote any such element or combination.

As explained in more detail below, the difference between the frequency measurements in the aiding and opposing configurations is indicative of (and indeed is substantially proportional to) the mutual inductance between the coils when the coin is present, which in turn is dependent upon the coin diameter. It is therefore possible to derive a diameter measurement without requiring the measurement of low-level signals.

Preferably, the diameter measurement is derived from the relationship between the mutual inductance when a coin is absent and the mutual inductance when the coin passes between the coils. Preferably, the mutual inductance when the coin passes between the coils is monitored and the minimum value is used for deriving a diameter measurement, to ensure that the measurement is taken when the coin is fully positioned between the coils.

BRIEF DESCRIPTION OF THE DRAWINGS

An arrangement embodying the invention will now be described by way of example with reference to the accompanying drawings, in which.

DETAILED DESCRIPTION

Figure 1:
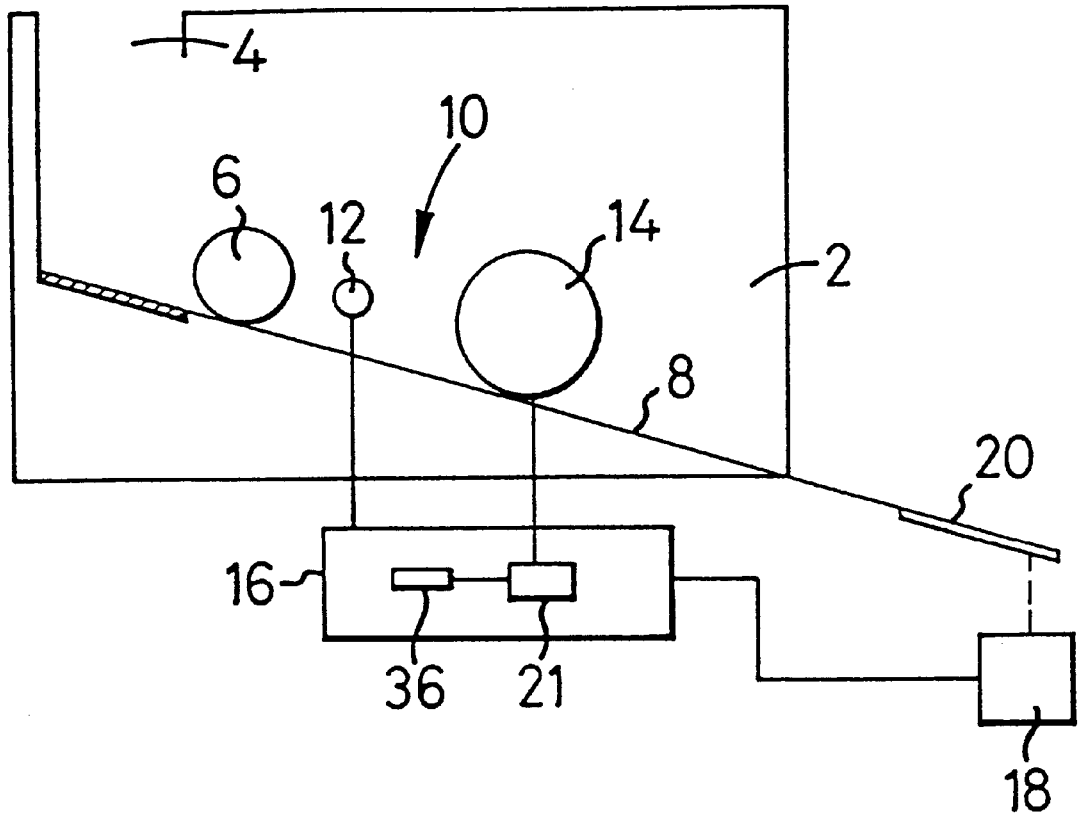
FIG. 1 schematically illustrates a coin validator in accordance with the invention.

Referring to FIG. 1, a validator 2 has an entry 4 through which coins, such as that shown at 6, may be inserted. The coins fall on to a ramp 8 and then roll down the ramp through a sensing area generally indicated at 10. The sensor area 10 contains one or more sensors for measuring the characteristics of the coin in order to determine its validity and denomination.

The illustrated embodiment includes a relatively small sensor 12 in the form of a coil positioned along side the ramp so that the face of the coin 6 passes in proximity to the coil 12 may be double-sided, i.e. there may be a separate coil on each side of the ramp so that the coin passes therebetween. This sensor could for example be used for thickness sensing.

A further sensor 14 comprises a double-sided coil, i.e. separate coils 14' and 14" (see FIG. 2) positioned one on each side of the ramp 8 so that the coin 6 passes between the coils.

The validator 2 is a multi-denomination validator, i.e. it is used for determining the validity and denomination of a number of different-denomination coins. The coils of the sensor 14 are larger than the largest-sized coin amongst the denominations to be validated by the validator 2. The lowermost parts of the coils of the sensor 14 are close to the ramp 8. These features mean that the proportion of the overlapping areas of the coils 14' and 14" which is occupied by the coin varies to the greatest extent with different denominations. This improves the discrimination between coins of similar, but slightly different, diameters.

The sensors 12 and 14 are coupled to a validation circuit 16, which drives the sensors, processes the signals from the sensors and determines validity and denomination. The circuit 16 can then generate suitable output signals, for example a signal which drives a solenoid 18 to control the operation of an accept/reject gate 20 located at the end of the ramp 8, thereby determining the final destination of the coin 6.

Figure 2:
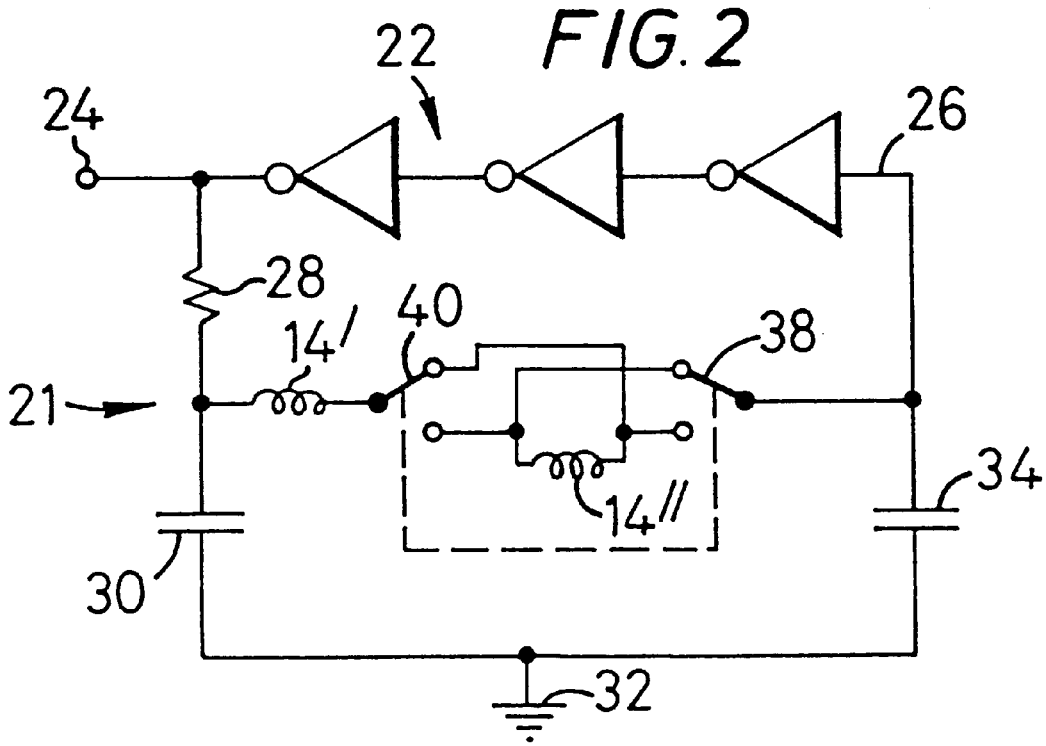
FIG. 2 is a circuit diagram of the diameter measuring part of the validator.

The diameter measuring part 21 of the validation circuit is shown in FIG. 2. This comprises an oscillator formed by an inverted 22 (in the illustrated embodiment this is formed by three individual series-connected integrated circuit inverter gates). There is a feedback path from the output 24 of the inverter 22 to its input 26. This feedback path includes a series circuit comprising a resistor 28 and the two coils 14' and 14". A capacitor 30 is connected between the junction of the resistor 28 and the coil 14', on the one hand, and ground 32 on the other hand. A capacitor 34 is connected in parallel between the input 26 and ground 32.

The circuit thus forms a simple oscillator, with the frequency at the output 24 being determined by the values of the capacitors 30 and 34 and the inductive values of the coils 14' and 14", in addition to the mutual inductance between the coils 14' and 14". The value of this mutual inductance changes as a coin 6 passes between the coils 14' and 14", to a degree which depends upon the amount by which the overlapping area between the coils 14' and 14" is occluded by the coin 6. The output 24 of the oscillator 22 is, as schematically illustrated in FIG. 1, delivered to a counter 36. The counter 36 can count the oscillations of the oscillator 21 and thereby determine its frequency.

The oscillator 21 includes two switches, 38 and 40 which, in the configuration shown in FIG. 2, interconnect the coils 14' and 14" in an opposed configuration, i.e. so that they are driven in opposite senses. By simultaneous operation of the switches 38 and 40, the connections to the coil 14" are reversed, so that the coils are coupled in a series-aiding manner, i.e. they are driven in the same sense.

Assuming that the inductances of the coils 14' and 14" are $L_1$ and $L_2$, respectively and that the mutual inductance therebetween is M, then when the coils are connected in a series-aiding configuration, the total inductance LA is:

$$LA=L_1+L_2+2M$$

When connected in the opposing configuration, the total inductance LO is:

$$LO=L_1+L_2-2M$$

The periods Pa of the oscillator 21, in the aiding configuration, is given by:

$$Pa^2=4\pi^2C(L_1+L_2+2M)$$

$$\text{where: } \frac{1}{c}=\frac{1}{c1}+\frac{1}{c2}$$

In the opposing configuration, the period Po is given by:

$$Po^2=4\pi^2C(L_1+L_2-2M)$$

Therefore, the difference between the periods in the two configurations is given by:

$$Pa^2-Po^2=4\pi^2C(4M)$$

$$(Pa+Po)\ (Pa-Po)=4\pi^2C(4M)$$

But $L_1+L_2>>2M$, and therefore the change in (Pa+Po) for different values of mutual inductance is proportionately much smaller than that in (Pa−Pa).

Therefore, $$k(Pa-Po)=4\pi^2C(4M)$$

Therefore, the difference in the period measurement is substantially proportional to the mutual coupling, M, between the coils.

The circuit operates as follows. The switches 38 and 40 are operated simultaneously at intervals which are significantly shorter than the time taken for the coin to pass between the coils 14' and 14". The interval may for example be approximately 0.5 ms. Each time the coils are switched to the aiding configuration, there is a brief delay, of for example 5 oscillator cycles, to allow the oscillator to settle, and then the counter 36 is caused to start counting up from zero. Each time the coils are switched to the opposing configuration, there is another brief delay before the counter 36 is caused to start counting down. At the end of the interval, the count reached by the counter 36 will be representative of the mutual inductance M, and this value is transferred to a register.

The idle value of M, Mi, is measured in this manner when no coin is present between the coils 14' and 14". The idle value could be measured before a coin is inserted, after a coin is inserted and before it reaches the coils, or after the coin leaves the coils (which is the preferred arrangement). After the coin starts to enter the space between the coils, the value M is repeatedly measured. The mutual inductance M will decrease as the coin occludes more of the area between the coils. The minimum value Mm obtained during the passage of the coin through the coils is determined (this corresponding to the position in which the coin is fully within the overlapping area of the coils 14' and 14"). A diameter measurement D is then obtained as follows:

$$D=Mi-Mm$$

This then can be compared with stored values to determined whether the measurement is indicative of a particular type of coin denomination.

It would be possible to base the diameter measurement simply on Mm, but by taking into account the idle value Mi it is possible to avoid the effects of variations in the mutual inductance due to changes in the coil positions, e.g. as a result of temperature changes, etc.

In the preferred embodiment, the frequency of the oscillator 21 exceeds 10 kHz, and there is time for at least 15 measurements when the smallest-sized coin passes between the coils.

This technique allows the diameter to be measured while avoiding "noise" effects due to embossing, and avoiding or substantially mitigating the effects of "lift-off".

If desired, the switching of the coil configuration could be arranged to be started by the detection of arrival of a coin to be tested.

In the above embodiment, the coils are connected in series, in either aiding or opposing configuration. It would alternatively be possible to switch between aiding and opposing parallel configurations, which produces a similar result.

What is claimed is:

1. A method of performing a diameter test on a coin, the method comprising:

passing the coin between a pair of inductors coupled in a oscillator circuit such that the oscillator frequency is dependent upon the values of the inductors and the mutual inductance therebetween, switching the inductors between an aiding configuration and an opposing configuration while the coin is passing therebetween, and providing a diameter-indicating measurement dependent upon the extent to which the frequency of the oscillator changes when the inductors are switched between the aiding and opposing configurations.

2. A method as claimed in claim 1, including the step of repeatedly switching the configurations of the coils such that they adopt each of an opposing and an aiding configuration a plurality of times during the passage of a coin.

3. A method as claimed in claim 1, including the step of determining when the minimum value of the frequency change occurs as the coin passes between the inductors and generating the diameter-indicating measurement on the basis of the oscillator frequencies at this time.

4. A method as claimed in claim 1, where the diameter-indicating measurement is based on the relationship between (a) the extent to which the frequency changes as a result of switching the configuration of the inductors while the coin is passing between the inductors and (b) the extent to which the frequency changes as a result of switching the configuration of the inductors in the absence of a coin.

5. A method as claimed in claim 1, wherein the frequency of the oscillator is measured by counting oscillator cycles in each period in which the inductors are coupled in the respective configuration.

6. A method as claimed in claim 5, wherein the initial cycles of the oscillator in each period are disregarded.

7. A method as claimed in claim 6, wherein the frequency is measured using a single counter which is arranged to count in a first sense in one configuration of the inductors and in the opposite sense in the other configuration.

8. A method as claimed in claim 1, wherein the inductors are switched between an aiding series configuration and an opposing series configuration.

9. A method as claimed in claim 1, wherein the inductors are switched between an aiding parallel configuration and an opposing parallel configuration.

10. A method as claimed in claim 1, wherein the diameter-indicating measurement is derived from the difference between the oscillator cycle periods in the respective configurations.

11. A coin diameter measuring apparatus comprising an oscillator circuit having an oscillator frequency, a pair of inductors in between which a coin can be arranged to pass, the inductors being coupled in the oscillator circuit, and means for switching between aiding an opposing configurations of the inductors during the passage of a coin, wherein the circuit is arranged so that the oscillator frequency is dependent upon the inductances of the inductors and the mutual inductance therebetween, and is further arranged to provide diameter-inducting measurement dependent upon the difference between the frequencies of the oscillator while the inductors are in the aiding and opposing configurations.

12. The apparatus of claim 11 including circuitry for determining a minimum value of the frequency difference as the coin passes between the inductors and for generating the diameter-indicating measurement on the basis of the minimum value.

13. The apparatus of claim 11, wherein the diameter-indicating measurement is based on the relationship between the frequency difference as the coin passes between the inductors and the frequency difference in the absence of a coin.

14. The apparatus of claim 11, further including a counter for counting oscillator cycles in each period in which the inductors are coupled in the respective configurations.

15. The apparatus of claim 14, wherein the counter disregards initial cycles of the oscillator in each period.

16. The apparatus of claim 15, wherein the counter is arranged to count in a first sense in one configuration of the inductors and in the opposite sense in the other configuration.

17. The apparatus of claim 11, wherein the inductors are switched between an aiding parallel configuration and an opposing parallel configuration.

18. A coin validator having a diameter measuring apparatus including a pair of inductors in between which a coin can be arranged to pass, the inductors being coupled in an oscillator circuit having an oscillator frequency, and means for switching between aiding and opposing configurations of the inductors in the passage of a coin, wherein the circuit is arranged so that the oscillator frequency is dependent upon the inductances of the inductors and the mutual inductance therebetween, and is further arranged to provide a diameter-indicating measurement which depends on the difference between the frequencies of the oscillator while the inductors are in the aiding and opposing configurations.

* * * * *